US011034175B2

(12) United States Patent
Koshiba

(10) Patent No.: US 11,034,175 B2
(45) Date of Patent: Jun. 15, 2021

(54) SLIDING MECHANISM AND INK-JET PRINTER

(71) Applicant: MIMAKI ENGINEERING CO., LTD., Nagano (JP)

(72) Inventor: Sho Koshiba, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 2 days.

(21) Appl. No.: 16/795,529

(22) Filed: Feb. 19, 2020

(65) Prior Publication Data

US 2020/0262222 A1 Aug. 20, 2020

(30) Foreign Application Priority Data

Feb. 20, 2019 (JP) ..... JP2019-028311

(51) Int. Cl.

| | |
|---|---|
| ***B41J 3/28*** | (2006.01) |
| ***B41J 19/20*** | (2006.01) |
| ***B41J 2/155*** | (2006.01) |
| ***B41J 25/00*** | (2006.01) |

(52) U.S. Cl.

CPC ..... *B41J 19/207* (2013.01); *B41J 2/155* (2013.01); *B41J 3/28* (2013.01); *B41J 25/001* (2013.01)

(58) Field of Classification Search

CPC . B41J 19/207; B41J 25/001; B41J 3/28; B41J 2/155

See application file for complete search history.

(56) References Cited

U.S. PATENT DOCUMENTS

| | | | | |
|---|---|---|---|---|
| 10,040,302 | B2 * | 8/2018 | Nakamura | B65H 23/1888 |
| 2012/0182336 | A1 * | 7/2012 | Itoh | B41J 25/003 347/8 |
| 2020/0269618 | A1 * | 8/2020 | Hiruma | B41J 2/04508 |

FOREIGN PATENT DOCUMENTS

| | | |
|---|---|---|
| JP | 2012210781 | 11/2012 |

* cited by examiner

*Primary Examiner* — Sharon Polk
(74) *Attorney, Agent, or Firm* — JCIPRNET

(57) ABSTRACT

A sliding mechanism is provided and includes a linear encoder for detecting a movement distance of a slider in relation to a support member. The sliding mechanism includes a slider that can move in relation to a support member, a slider that can move in relation to the support member as well as the slider, a linear scale fixed to the slider and a sensor fixed to the slider; and a linear encoder for detecting a movement distance of the slider in relation to the support member. In the sliding mechanism, the slider is transferred in relation to the support member and the slider, and subsequently the slider is transferred in relation to the support member and the slider, while the slider is kept in a state of being stopped.

15 Claims, 7 Drawing Sheets

SLIDING MECHANISM AND INK-JET PRINTER

CROSS REFERENCE TO RELATED APPLICATIONS

This application claims the priority benefit of Japanese Patent Application No. 2019-028311, filed on Feb. 20, 2019. The entirety of the above-mentioned patent application is hereby incorporated by reference herein and made a part of this specification.

TECHNICAL FIELD

The present disclosure relates to a sliding mechanism including a slider that linearly moves in a predetermined direction. Furthermore, the present disclosure relates to an ink-jet printer including the sliding mechanism.

DESCRIPTION OF THE BACKGROUND ART

Conventionally, known is an ink-jet printer of a so-called flat-bed type, which carries out printing operation on a print medium placed on a stage part (refer to Patent Document 1). An ink-jet printer, described in Patent Document 1, has a carriage on which a discharging head is mounted, a Y-bar provided with a Y-axis guide rail for guiding the carriage in a main travelling direction, and a Y-axis transfer mechanism for moving the carriage in the main travelling direction in relation to the Y-bar. Moreover, the ink-jet printer includes: a slider, to which two columns, being provided at both end sides of the Y-bar in the main travelling direction, are individually fixed; an X-axis frame provided with an X-axis guide rail for guiding the slider in a sub travelling direction; and an X-axis transfer mechanism for moving the slider in the sub travelling direction in relation to the X-axis frame. The X-axis frame is placed at both end sides of a stage part in the main travelling direction.

In the ink-jet printer described in Patent Document 1, a liner scale is installed on the X-axis frame. The liner scale is placed along the sub travelling direction. On a top surface of the liner scale, there are formed minute bumps in a series in the sub travelling direction. In the slider, there is installed a sensor in such a way as to face the top surface of the liner scale. In the ink-jet printer described in Patent Document 1, a movement distance of the slider in relation to the X-axis frame can precisely be detected by use of the sensor installed to the slider and the liner scale. Therefore, in the ink-jet printer, an ink-jet head can precisely be moved in the sub travelling direction, in relation to a print medium placed on the stage part, on the basis of a detection result of the sensor.

[Patent Document 1] Japanese Unexamined Patent Application Publication No. 2012-210781

In the case of the ink-jet printer described in Patent Document 1, a distance through which the slider can move in relation to the X-axis frame is comparatively long; and therefore, without making the linear scale long, there appears a place where a movement distance of the slider in relation to the X-axis frame cannot be detected. Accordingly, in the case of the ink-jet printer, a length of the linear scale becomes long so that a cost of the linear scale becomes high.

Then, it is an objective of the present disclosure to provide a sliding mechanism including a slider that can linearly move in relation to a support member, and a linear encoder for detecting a movement distance of the slider in relation to the support member; in the sliding mechanism, even though a distance through which the slider can move in relation to the support member is comparatively long, the movement distance of the slider in relation to the support member can be detected, while a length of a linear scale being made short. Moreover, it is another objective of the present disclosure to provide an ink-jet printer including the sliding mechanism.

SUMMARY

In order to solve the issue described above, a sliding mechanism according to the present disclosure includes: a slider that is capable of linearly moving in relation to a support member in a predetermined direction; a second slider that is capable of linearly moving in relation to the support member as well as the slider in the same direction as a moving direction of the slider; a slider transfer mechanism that transfers the slider; a second slider transfer mechanism that transfers the second slider; and a linear encoder for detecting a movement distance of the slider in relation to the support member. The linear encoder includes a linear scale fixed to one of the slider and the second slider, and a sensor fixed to the other of the slider and the second slider. The second slider transfer mechanism transfers the second slider in relation to the support member and the slider; and subsequently, while the second slider is kept in a state of being stopped, the slider transfer mechanism transfers the slider in relation to the support member and the second slider.

In the sliding mechanism according to the present disclosure, the linear scale is fixed to either the slider or the second slider, and the sensor is fixed to the other of the slider and the second slider. Moreover, according to the present disclosure, after transferring the second slider in relation to the support member and the slider, the slider is transferred in relation to the support member and the second slider, while the second slider is kept in a state of being stopped. In other words, according to the present disclosure; before transferring the slider, either the linear scale or the sensor is transferred together with the second slider in relation to the support member and the slider, and subsequently the slider is transferred in relation to the support member and the second slider in such a way as to relatively move the sensor in relation to the linear scale.

Therefore, according to the present disclosure, even though a distance through which the slider can move in relation to the support member is comparatively long, and even though a length of the linear scale is made short, it becomes possible to detect the movement distance of the slider in relation to the support member by use of the linear scale and the sensor. In other words, according to the present disclosure, even though a distance through which the slider can move in relation to the support member is comparatively long, it becomes possible to detect the movement distance of the slider in relation to the support member, while the length of the linear scale is made short.

In the present disclosure, it is preferable that the linear scale is fixed to the slider, and the sensor is fixed to the second slider. According to this configuration, being compared to a case where the linear scale is fixed to the second slider, the second slider can be downsized.

In the present disclosure, it is preferable that the second slider transfer mechanism includes a motor fixed to one of the slider and the second slider, and a power transmission mechanism for transmitting power of the motor to the other of the slider and the second slider, from the motor. According to this configuration, the second slider transfer mechanism together with the slider and the second slider can be transferred in relation to the support member; and therefore, being compared to a case where the motor is installed to either of the support member or the second slider, and the power transmission mechanism transmits the power of the motor to the other of the support member or the second slider, from the motor; the power transmission mechanism can be downsized.

In the present disclosure, it is preferable that the power transmission mechanism includes a clutch placed in a power transmission route, which leads from the motor to the other of the slider and the second slider; and when the second slider moves in relation to the support member and the slider, the clutch transmits the power of the motor to the other of the slider and the second slider; and when the slider moves in relation to the support member and the second slider, the clutch blocks up the power transmission route from the motor to the other of the slider and the second slider. According to this configuration, at the time when the slider is transferred in relation to the support member and the second slider, it becomes possible by way of a comparatively easy way to maintain the slider, in the state of being stopped, at the stop position.

In the present disclosure, for example, the power transmission mechanism includes a rack fixed to the other of the slider and the second slider, and a pinion connected to an output shaft of the motor by an intermediary of the clutch, and the pinion being meshed with the rack; and the clutch transmits the power of the motor to the pinion, at a time when the second slider moves in relation to the support member and the slider; and the clutch blocks up the power transmission route from the motor to the pinion, at a time when the slider moves in relation to the support member and the second slider.

In the present disclosure, it is preferable that the motor is installed to the slider; and the rack is fixed to the second slider. According to this configuration, being compared to a case where the motor is fixed to the second slider, the second slider can be downsized.

In the present disclosure, the sliding mechanism includes a retainer mechanism for retaining the second slider, being in a stop state, at a stop position. According to this configuration, it becomes possible to transfer the slider in relation to the support member and the second slider, in the state where the second slider is stopped for sure. Therefore, detection accuracy by use of the linear encoder with regard to the movement distance of the slider can be enhanced.

In the present disclosure, for example, the retainer mechanism includes a contacting member that is capable of contacting the support member with a predetermined contact pressure; and a contacting member move mechanism that moves the contacting member between a contacting position, where the contacting member contacts the support member with the predetermined contact pressure, and a non-contacting position, where the contacting member is distant from the support member so as not to contact the support member; and the contacting member move mechanism is installed to the second slider. In this case, a structure of the retainer mechanism can comparatively be simplified.

In the present disclosure, for example, the sliding mechanism includes a detection mechanism for detecting a stop position of the second slider in relation to the slider. In this case, the slider can automatically be stopped, on the basis of a detection result of the detection mechanism.

In the present disclosure, it is preferable that the sliding mechanism includes a guide rail, which is fixed to the support member, for guiding the slider and the second slider in the moving direction of the slider; a guide block, being fixed to the slider, which engages with the guide rail in such a way as to be slidable, and a second guide block, being fixed to the second slider, which engages with the guide rail in such a way as to be slidable. According to this configuration, the slider and the second slider can be guided by use of the guide rail in common so that the structure of the sliding mechanism cam be simplified.

The sliding mechanism according to the present disclosure can be used for an ink-jet printer. The ink-jet printer, for example, includes two sliding mechanisms, each of which is the sliding mechanisms according to the present disclosure; an ink-jet head that discharges an ink drop on a print medium; a carriage on which the ink-jet head is mounted; a carriage holding member that holds the carriage in such a way as to be movable in a main travelling direction; and the support member. The support member includes a table where the print medium is placed. The two sliding mechanisms are individually placed at each of both ends of the table in the main travelling direction. An end part of the carriage holding member in the main travelling direction is connected to the slider. The slider and the second slider are movable in a sub travelling direction that is perpendicular to a vertical direction and the main travelling direction.

In the ink-jet printer, the movement distance of the carriage holding member in relation to the table can be detected, while the length of the linear scale being made short, even though a distance through which the carriage holding member can move in relation to the table, where the print medium is placed, is comparatively long. Therefore, in the ink-jet printer, even though a length of the table in the sub travelling direction is long, and even though the slider is able to move in relation to the table in an entire range of the sub travelling direction, it becomes possible to detect the movement distance of the carriage holding member in relation to the table, while the length of the linear scale is made short.

Advantageous Effect of the Invention

As described above, in the sliding mechanism according to the present disclosure, the movement distance of the slider in relation to the support member can be detected, while the length of the linear scale being made short, even though the distance through which the slider can move in relation to the support member is comparatively long. Furthermore, in the ink-jet printer according to the present disclosure, the movement distance of the carriage holding member in relation to the table can be detected, while the length of the linear scale being made short, even though the distance through which the carriage holding member can move in relation to the table, where the print medium is placed, is comparatively long.

DESCRIPTION OF EMBODIMENTS

A preferred embodiment according to the present disclosure is explained below with reference to the drawings.

(Schematic Configuration of Ink-Jet Printer)

Figure 1:
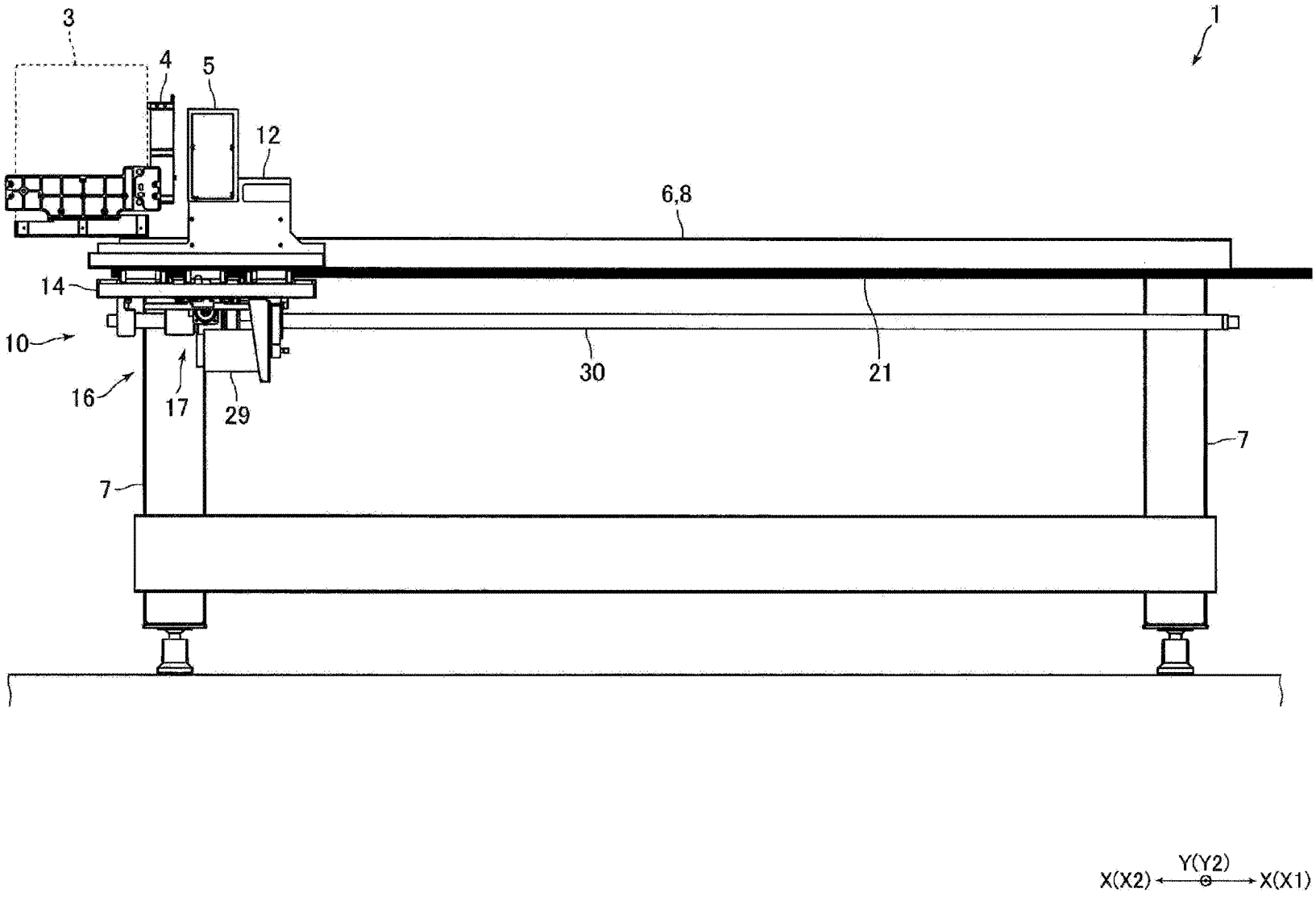
FIG. 1 is a side view drawing of an ink-jet printer according to an embodiment of the present disclosure.

FIG. 1 is a side view drawing of an ink-jet printer 1 according to an embodiment of the present disclosure.

The ink-jet printer 1 according to the present embodiment (hereinafter referred to as a printer 1) is an ink-jet printer for business use that carries out printing operation on a print medium, such as a printing paper. Moreover, the printer 1 according to the present embodiment is an ink-jet printer of a so-called flat-bed type. The printer 1 includes an ink-jet head 3 that discharges an ink drop on a print medium, a carriage 4 on which the ink-jet head 3 is mounted, a Y-bar 5 as a carriage holding member that holds the carriage 4 in such a way as to be movable in a main travelling direction, and a carriage transfer mechanism (not illustrated) for moving the carriage 4 in relation to the Y-bar 5, in the main travelling direction.

The printer 1 further includes a table 6 where the print medium is placed, and a support leg 7 that supports the table 6. In the present embodiment, a support member 8 is structured by use of the table 6 and the support leg 7, in such a way as to hold the Y-bar 5 so as to be movable in a sub travelling direction that is perpendicular to a vertical direction and the main travelling direction. Moreover, the printer 1 includes a sliding mechanism 10 that slides the Y-bar 5 in relation to the support member 8, in the sub travelling direction (namely, linearly transferring the Y-bar 5).

In the following explanation, the main travelling direction (i.e., a Y-direction shown in FIG. 1 and others) and the sub travelling direction (i.e., an X-direction shown in FIG. 1 and others) are dealt with as a right-and-left direction and a front-and-back direction, respectively. Then, an X1-direction side, shown in FIG. 1 and the like as one direction side in the front-and-back direction is, represented as a "front" side, and an X2-direction side, shown in FIG. 1 and the like as an opposite side to the above, is represented as a "rear" side; and meanwhile a Y1-direction side, shown in FIG. 2 and the like as one direction side in the right-and-left direction, is represented as a "right" side, and a Y2-direction side, shown in FIG. 2 and the like as an opposite side to the above, is represented as a "left" side.

The carriage 4 is placed at an upper side of the table 6. The ink-jet head 3 discharges an ink drop from an upper side, toward the print medium placed on a top surface of the table 6. The ink that the ink-jet head 3 discharges is, for example, ultraviolet curable ink (UV ink). To the carriage 4, there is installed an ultraviolet radiation unit that radiates ultraviolet rays to the ink discharged from the ink-jet head 3. The carriage transfer mechanism includes, for example, a motor, a drive pulley to be turned with power of the motor, a driven pulley, a belt placed over the drive pulley and the driven pulley, and the like. A part of the belt is fixed to the carriage 4. The Y-bar 5 is shaped as a rectangular form elongated in a right-and-left direction. Both ends of the Y-bar 5 at right and left sides are supported from an under side by use of Y-bar support members 12.

The table 6 is shaped like a rectangular thick plate. In a right-and-left direction, the table 6 is placed between two Y-bar support members 12. The support leg 7 supports both ends of the table 6 at front and back sides, from an under side. The sliding mechanism 10 is placed at each of both the ends of the table 6 at right and left sides. In other words, the printer 1 includes two sliding mechanisms 10. Explained below is a specific structure of the sliding mechanism 10. Incidentally, explained below is a structure of the sliding mechanism 10, positioned at a left side, of the two sliding mechanisms 10 placed at both the ends of the table 6 at the right and left sides.

(Structure of Sliding Mechanism)

Figure 2:
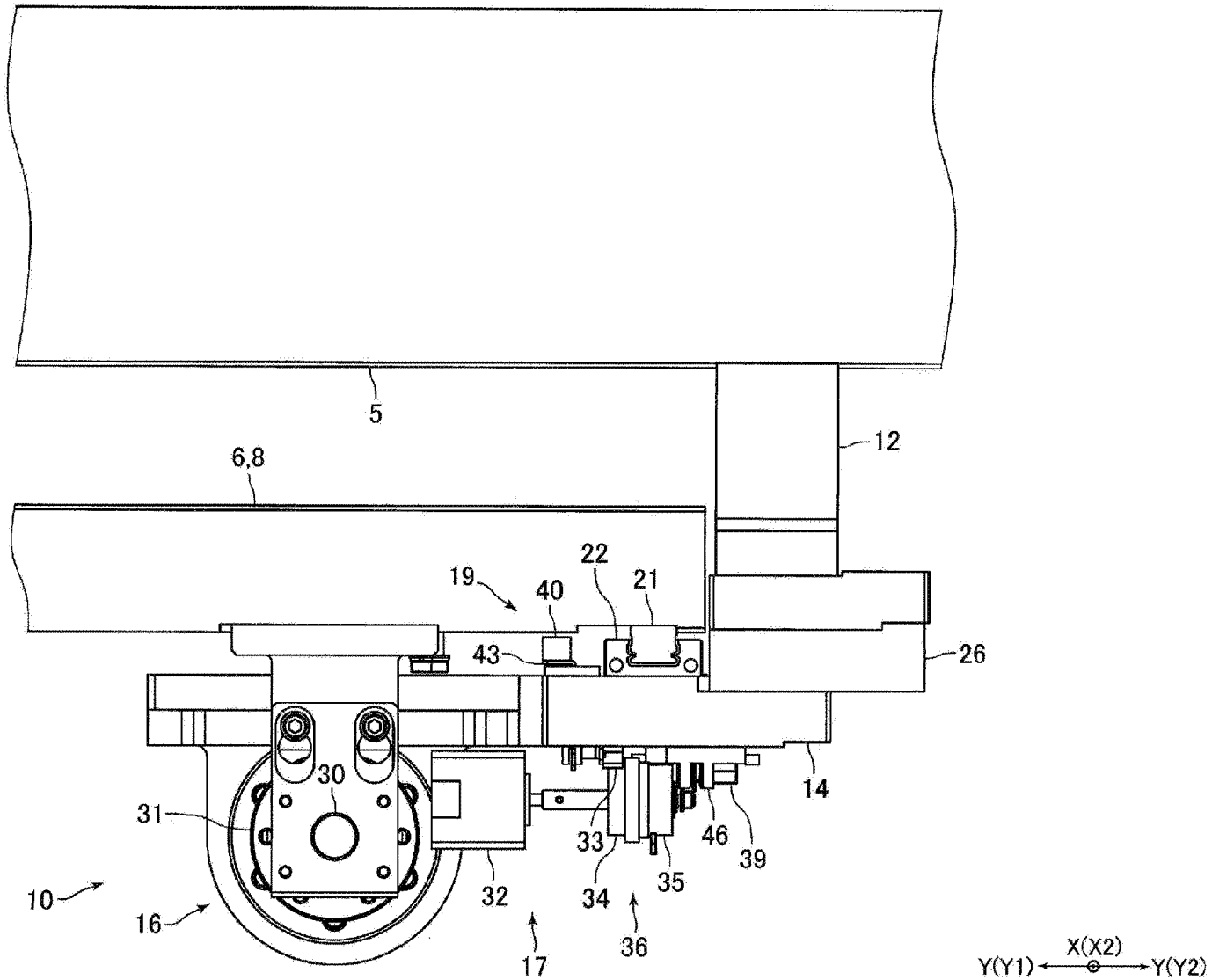
FIG. 2 is a rear-view drawing for explaining a structure of a sliding mechanism shown in FIG. 1.
Figure 3:
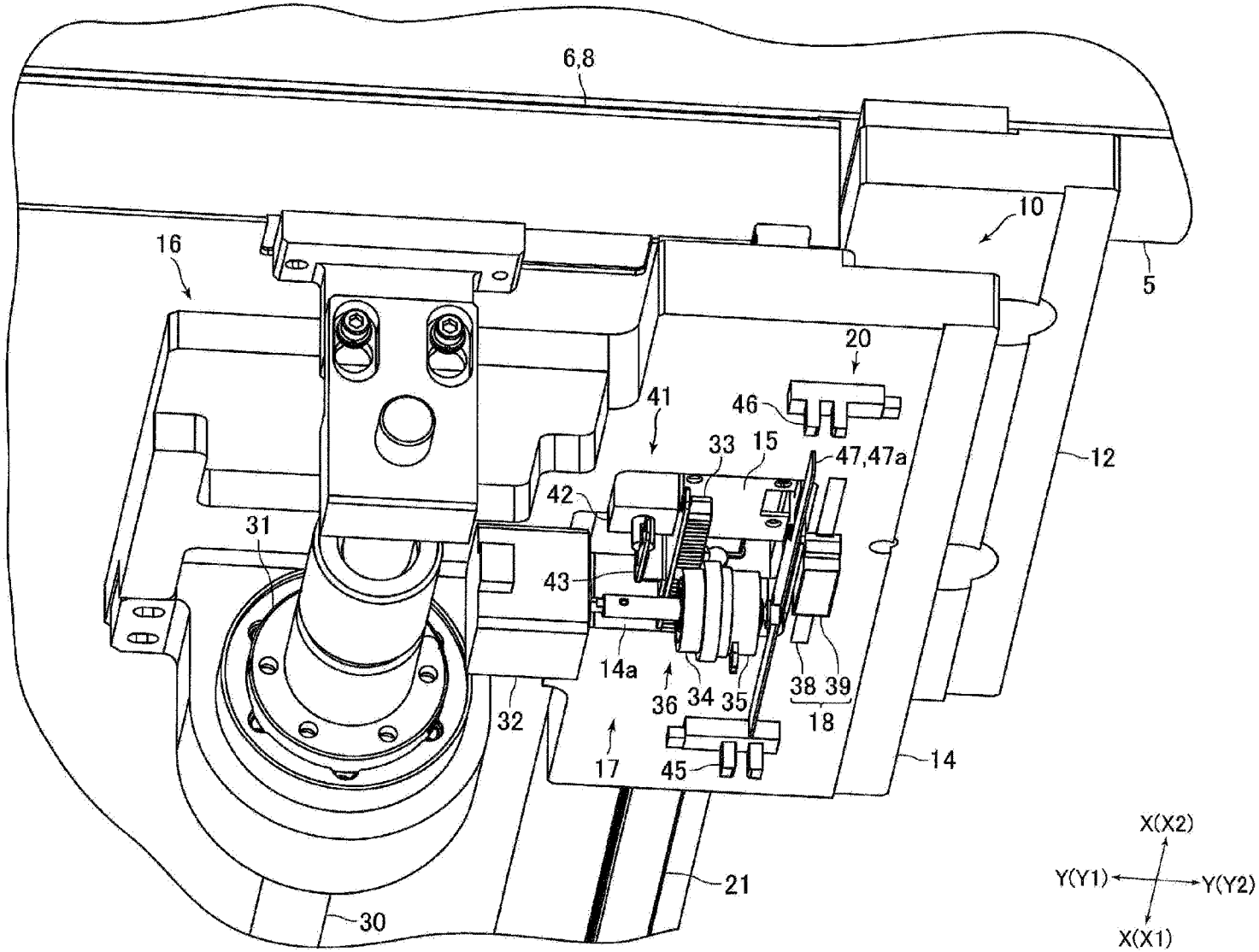
FIG. 3 is a perspective view drawing for explaining the structure of the sliding mechanism shown in FIG. 2.
Figure 4:
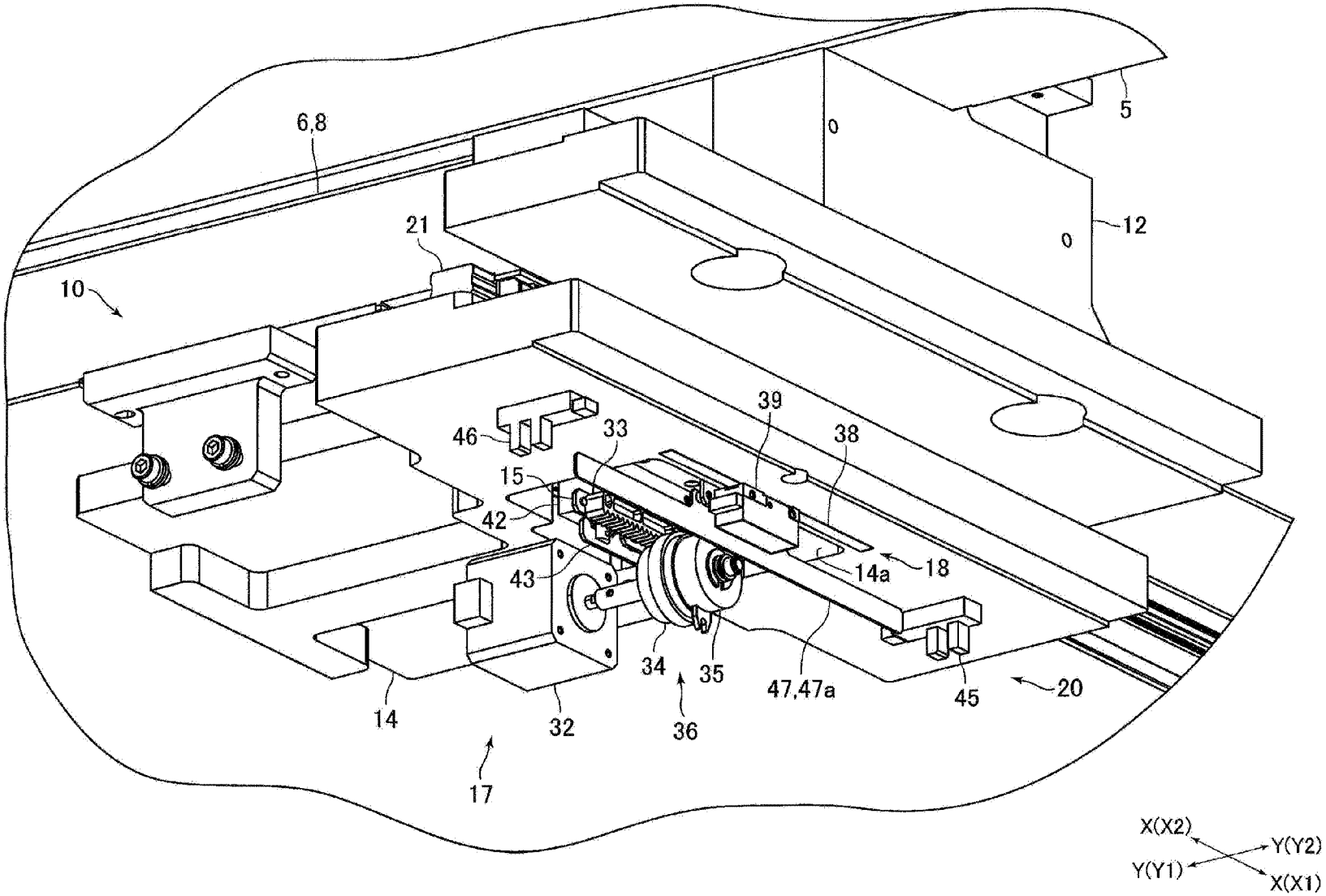
FIG. 4 is another perspective view drawing for explaining the structure of the sliding mechanism shown in FIG. 2.
Figure 5:
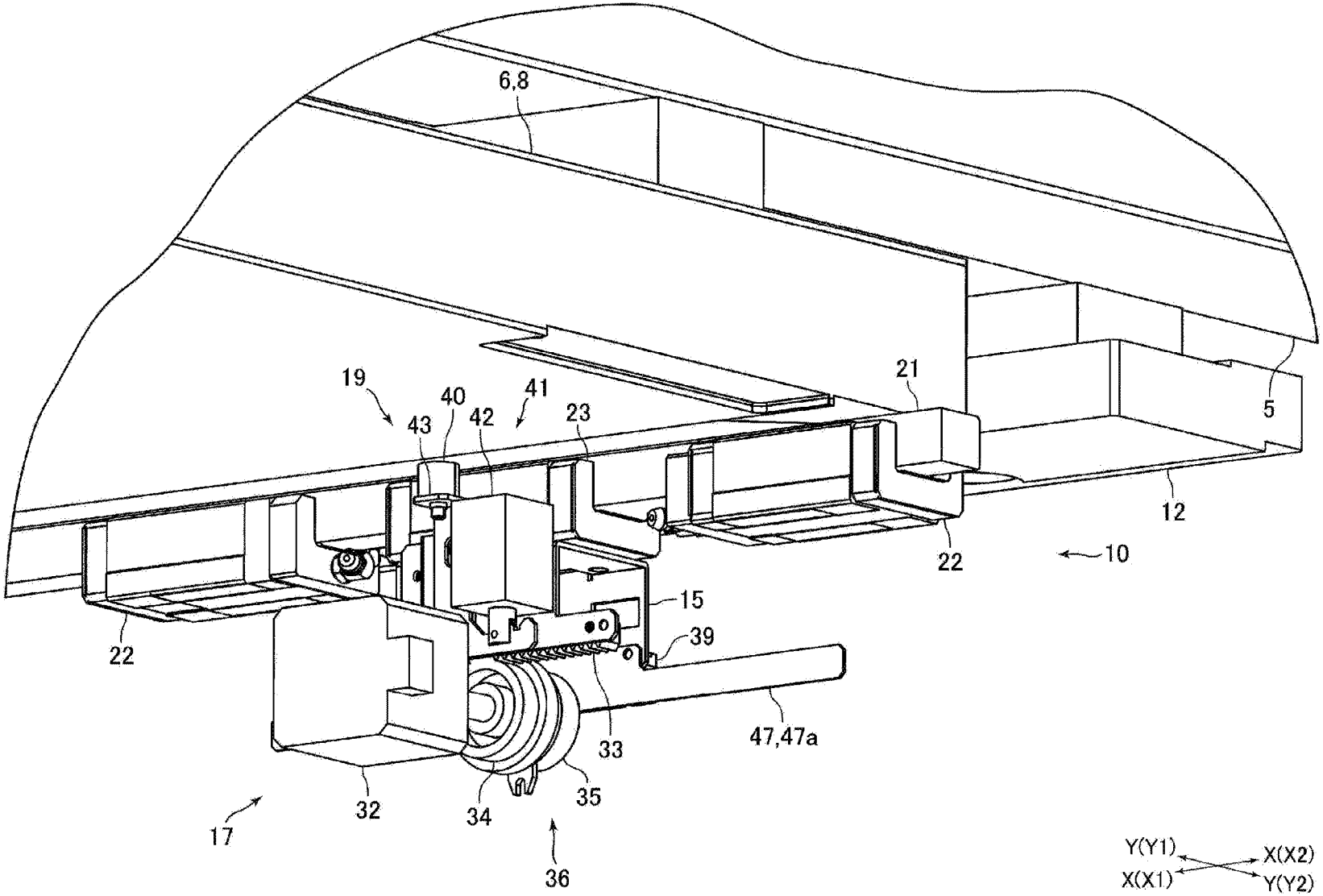
FIG. 5 is still another perspective view drawing for explaining the structure of the sliding mechanism shown in FIG. 2.
Figure 6:
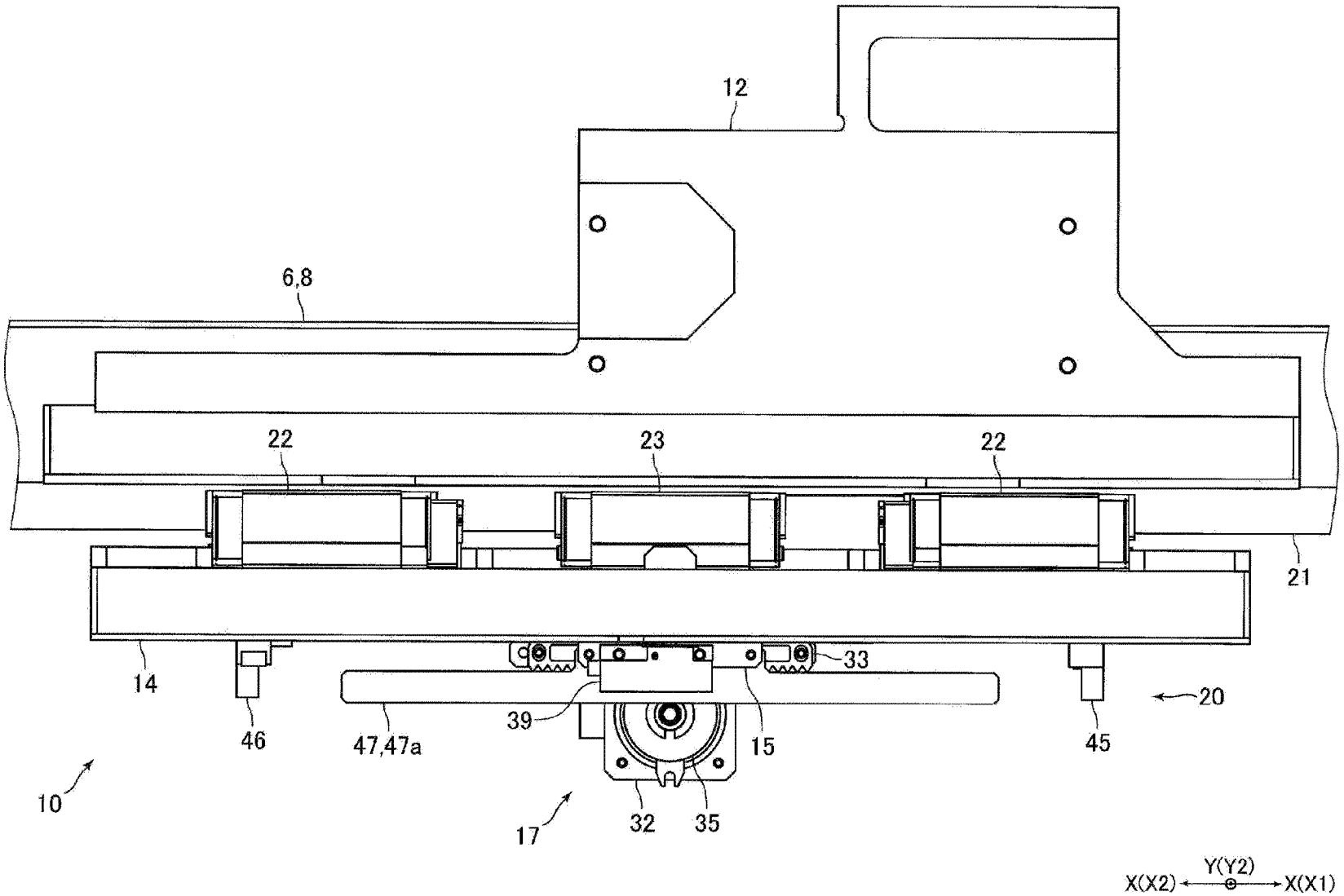
FIG. 6 is a side view drawing for explaining the structure and operation of the sliding mechanism shown in FIG. 2.
Figure 7:
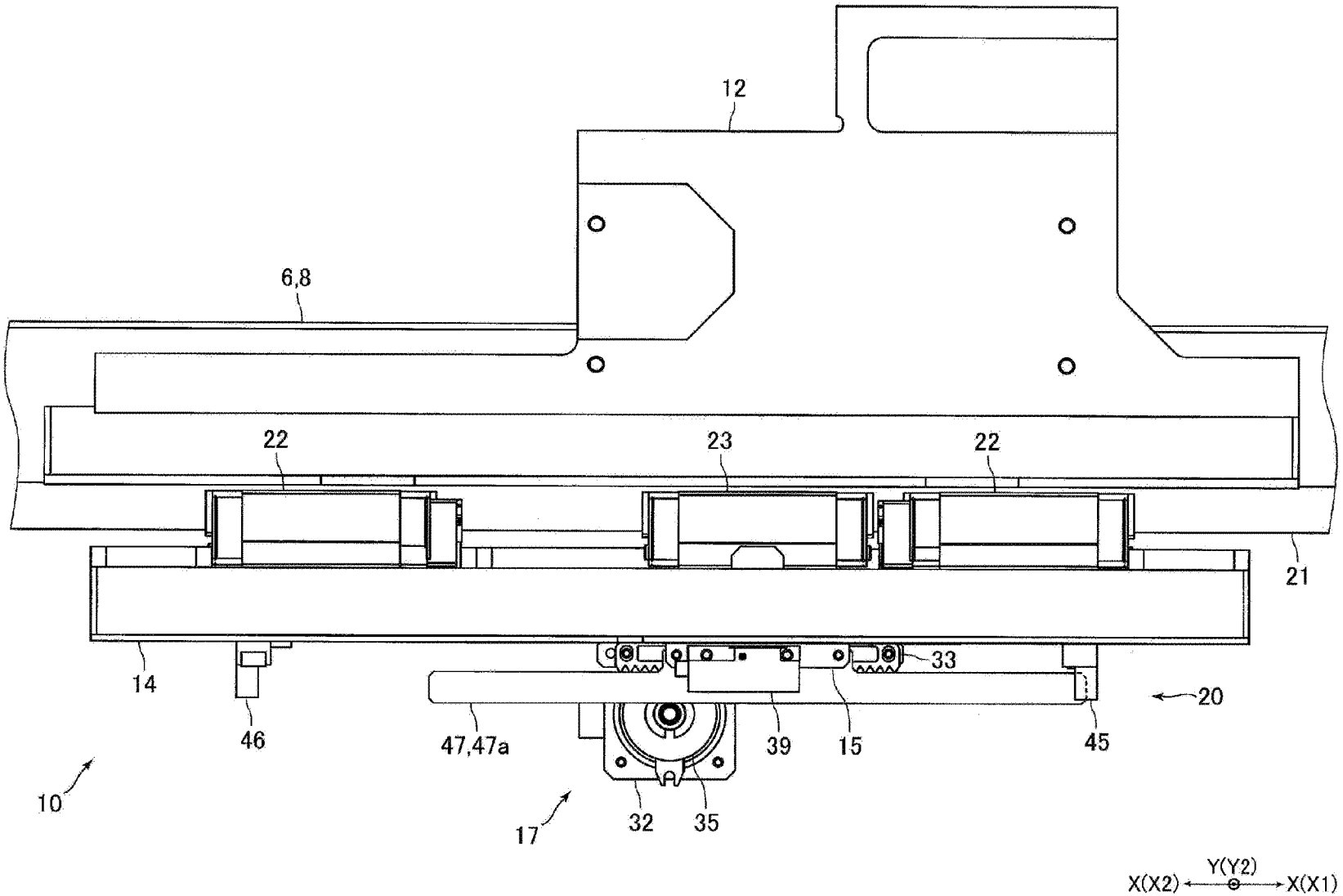
FIG. 7 is another side view drawing for explaining the structure and operation of the sliding mechanism shown in FIG. 2.

FIG. 2 is a rear-view drawing for explaining a structure of the sliding mechanism 10 shown in FIG. 1. FIG. 3 through FIG. 5 are individually perspective view drawings for explaining the structure of the sliding mechanism 10 shown in FIG. 2. FIG. 6 and FIG. 7 are individually side view drawings for explaining the structure and operation of the sliding mechanism 10 shown in FIG. 2.

The sliding mechanism 10 includes: a slider 14 that can linearly move in relation to the support member 8 in a front-and-back direction (the sub travelling direction); another slider 15, as a second slider, which can linearly move in relation to the support member 8 as well as the slider 14 in the front-and-back direction (in other words, in the same direction as a moving direction of the slider 14); a slider transfer mechanism 16 to transfer the slider 14; and a slider transfer mechanism 17, as a second slider transfer mechanism, to transfer the slider 15.

Moreover, the sliding mechanism 10 includes: a linear encoder 18 for detecting a movement distance of the slider 14 in relation to the support member 8; a retainer mechanism 19 for retaining the slider 15, being in a stop state, at a stop position; a detection mechanism 20 for detecting the stop position of the slider 15 in relation to the slider 14; a guide rail 21 for guiding the slider 14 and the slider 15 in a front-and-back direction; and a guide block 22 and a guide block 23 that engage with the guide rail 21 in such a way as to be slidable. Incidentally, in FIG. 4, FIG. 6, and FIG. 7, the slider transfer mechanism 16 and the like are not illustrated. Moreover, in FIG. 5, the slider 14 and the slider transfer mechanism 16 and the like are not illustrated.

The slider 14 is shaped so as to be like a flat plate. The slider 14 is placed in such a way that a thickness direction of the slider 14 is consistent with a vertical direction. Moreover, the slider 14 is placed at a side lower than the table 6 is. To the slider 14, there is connected the Y-bar support member 12 that supports a left end part of the Y-bar 5. Concretely to describe, as illustrated in FIG. 2, a left end part of the slider 14 is placed at a further left side than a left end surface of the table 6, and a lower surface of the Y-bar support member 12 is fixed to the left end part of the slider 14 by the intermediary of a plate-like member 26. In other words, the end part of the Y-bar 5 in a right-and-left direction is connected to the slider 14, by the intermediary of the plate-like member 26 and the Y-bar support member 12. Incidentally, in FIG. 1 and FIG. 3 through FIG. 7, the plate-like member 26 is not illustrated.

The slider 15 is formed by way of bending a metal plate, such as a steel plate and the like, into a predetermined shape. The slider 15 is placed at a lower side of the table 6. In the slider 14, there is formed a through hole **14*a* in which the slider 15 is placed. The through hole 14*a* completely passes through the slider 14 in a vertical direction. The through hole 14*a* is formed almost at a center position of the slider 14 in a front-and-back direction. A width of the through hole 14*a* in the front-and-back direction is wider than a length of the slider 15 in the front-and-back direction, in such a way that the slider 15 is able to move for a predetermined distance in the front-and-back direction in relation to the slider 14**.

The guide rail 21 is fixed to a lower surface of a left end part of the table 6. In other words, the guide rail 21 is fixed to the support member 8. The guide rail 21 is placed in such a way that a longitudinal direction of the guide rail 21 is consistent with a front-and-back direction. The guide block 22 is fixed to the slider 14. Concretely to describe, two guide blocks 22 are fixed to an upper surface of the slider 14. The guide block 23 is fixed to the slider 15. Concretely to describe, one guide block 23 is fixed to an upper surface of the slider 15.

The guide blocks 22 and the guide block 23 engage with the guide rail 21 from a lower side. One guide block 22 of the two guide blocks 22 is fixed to the upper surface of the slider 14, at a position of a further front side than the through hole 14*a*; and meanwhile, the other guide block 22 is fixed to the upper surface of the slider 14, at a position of a further rear side than the through hole 14*a*. The guide block 23 is located between the two guide blocks 22 in the front-and-back direction. The guide block 23 of the present embodiment is a second guide block.

The slider transfer mechanism 16 includes: a motor 29 installed to the support member 8; and a ball screw unit having a screw shaft (lead screw) 30 and a nut component 31. The screw shaft 30 is held by the support member 8, in such a way as to be rotatable, in a state where a shaft direction of the screw shaft 30 is consistent with a front-and-back direction. The nut component 31 is installed at a right end side of the slider 14. To the screw shaft 30, there is connected the motor 29, by the intermediary of a pulley and a belt; in such a way that the screw shaft 30 can be turned with power of the motor 29. According to the present embodiment, if the motor 29 is driven, the screw shaft 30 turns so that the slider 14 moves together with the nut component 31, running along the screw shaft 30 in the front-and-back direction. In other words, if the motor 29 is driven, the Y-bar 5 moves together with the slider 14 in the front-and-back direction.

Incidentally, the motor 29 is not illustrated in FIG. 2 and FIG. 3. Alternatively, with the motor 29 being installed to the slider 14; the screw shaft 30 may be fixed to the support member 8, while the nut component 31 being installed to the slider 14 so as to be rotatable. In this case, the motor 29 is connected to the nut component 31, by the intermediary of a pulley and a belt; and the nut component 31 is in a state of being able to turn with power of the motor 29. Then, in this case, if the motor 29 is driven, the nut component 31 turns so that the slider 14 moves together with nut component 31, running along the screw shaft 30 in the front-and-back direction.

The slider transfer mechanism 17 includes: a motor 32 installed to the slider 14; a rack 33 fixed to the slider 15, and a pinion 34 connected to an output shaft of the motor 32. The motor 32 is fixed to a lower surface of the slider 14. The output shaft of the motor 32 protrudes toward a left side. The rack 33 is placed in such a way that a longitudinal direction of the rack 33 is consistent with a front-and-back direction. A length of the rack 33 in the front-and-back direction is almost the same as the length of the slider 15 in the front-and-back direction.

The pinion 34 engages with the rack 33. The pinion 34 is placed at a lower side of the rack 33. Moreover, the pinion 34 is connected to the output shaft of the motor 32, by the intermediary of a clutch 35. In other words, there is placed the clutch 35 in a power transmission route to the slider 15 from the motor 32. In an inner circumferential side of the pinion 34, the output shaft of the motor 32 is inserted through.

The clutch 35 is an electromagnetic clutch. The clutch 35 transmits power of the motor 32 to the pinion 34, at a time when the slider 15 moves in relation to the support member 8 and the slider 14. In other words, when the slider 15 moves in relation to the support member 8 and the slider 14, the pinion 34 turns together with the output shaft of the motor 32. Then, at a time when the slider 14 moves in relation to the support member 8 and the slider 15, the clutch 35 blocks up a power transmission route to the pinion 34 from the motor 32. In other words, when the slider 14 moves in relation to the support member 8 and the slider 15, the pinion 34 idly turns in relation to the output shaft of the motor 32.

In this way, when the slider 15 moves in relation to the support member 8 and the slider 14, the clutch 35 transmits the power of the motor 32 to the slider 15; and meanwhile, when the slider 14 moves in relation to the support member 8 and the slider 15, the clutch 35 blocks up the power transmission route from the motor 32 to the slider 15. In the present embodiment, by use of the pinion 34, the clutch 35 and the like, there is structured a power transmission mechanism 36 for transmitting the power of the motor 32 to the slider 15 from the motor 32.

The linear encoder 18 includes a linear scale 38 fixed to the slider 14, and a sensor 39 fixed to the slider 15. The linear scale 38 is fixed to the lower surface of the slider 14. The linear scale 38 is placed in such a way that a longitudinal direction of the linear scale 38 is consistent with a front-and-back direction. Moreover, the linear scale 38 is placed at a left side of the through hole 14*a*. A lower surface of the linear scale 38 is made so as to be a bumpy surface where minute bumps are formed in a series.

The sensor 39 is an optical sensor of a reflection type, which includes a light emitting element and a light receiving element. The sensor 39 is placed at a lower side of the linear scale 38; and a light emitting surface of the light emitting element and a light receiving surface of the light receiving element of the sensor 39 face the lower surface of the linear scale 38. Provided with, for example, a resolution of 0.1 micrometer (μm), the linear encoder 18 detects a movement distance of the slider 14 in relation to the support member 8.

The retainer mechanism 19 includes a contacting member 40 that can contact the support member 8 with a predetermined contact pressure, and a move mechanism 41 as a contacting member move mechanism that moves the contacting member 40. The move mechanism 41 is installed to the slider 15. The move mechanism 41 has a solenoid 42 fixed to the slider 15, and a lifting member 43 that is connected to the solenoid 42 and lifts up and down with power of the solenoid 42. The contacting member 40 is shaped so as to be cylindrical, and placed in such a way that an axial direction of the contacting member 40, being cylindrically shaped, is consistent with a vertical direction. The contacting member 40 is fixed to an upper end part of the lifting member 43. Then, the contacting member 40 is placed at a position of a lower side of the table 6, and the position being at an upper side of an upper surface of the slider 14.

The contacting member 40 can be moved between a contacting position, where a top end surface of the contacting member 40 contacts a lower surface of the table 6 with the predetermined contact pressure, and a non-contacting position (a position shown in FIG. 2), where the top end surface of the contacting member 40 is distant from the lower surface of the table 6 so as not to contact the lower surface of the table 6. In other words, the move mechanism 41 moves the contacting member 40 between the contacting position, where the contacting member 40 contacts the support member 8 with the predetermined contact pressure, and the non-contacting position, where the contacting member 40 is distant from the support member 8 so as not to contact the support member 8. At a time when the slider 15 moves in relation to the support member 8 and the slider 14 in the front-and-back direction, the contacting member 40 is placed at the non-contacting position; and meanwhile, at a time of retaining the slider 15, being in a stop state, at a stop position; the contacting member 40 is placed at the contacting position.

The detection mechanism 20 includes two sensors 45 and 46 fixed to the slider 14, and a light-blocking member 47 fixed to the slider 15. Each of the sensors 45 and 46 is an optical sensor of a light-transmissive type, which has a light emitting element and a light receiving element. The sensors 45 and 46 are fixed to the lower surface of the slider 14. Moreover to describe, the sensor 45 is fixed to the lower surface of the slider 14, at a position of a further front side than the through hole 14*a*; and meanwhile, the sensor 46 is fixed to the lower surface of the slider 14, at a position of a further rear side than the through hole 14*a*. The light-blocking member 47 is shaped by use of a metal plate, such as a steel plate and the like. Then, the light-blocking member 47 is shaped so as to be a flat plate. The light-blocking member 47 is provided with a light-blocking part 47*a* for blocking in a space between the light emitting element and the light receiving element of each of the sensors 45 and 46.

In the present embodiment, if the light-blocking part 47*a* blocks in the space between the light emitting element and the light receiving element of the sensor 45 while the slider 15 moves toward a front side in relation to the slider 14, a stop position of the slider 15 moving toward the front side in relation to the slider 14 is detected so that the motor 32 stops. In the meantime, if the light-blocking part 47*a* blocks in the space between the light emitting element and the light receiving element of the sensor 46 while the slider 15 moves toward a rear side in relation to the slider 14, a stop position of the slider 15 moving toward the rear side in relation to the slider 14 is detected so that the motor 32 stops. Incidentally, a movement range of the slider 15 is restricted in such a way that, the guide blocks 22 fixed to the slider 14 and the guide block 23 fixed to the slider 15 do not contact each other, even though the slider 15 moves in relation to the slider 14.

(Operation of Ink-Jet Printer)

The ink-jet printer 1 carries out printing operation on a print medium by way of alternate repetition of reciprocating the carriage 4 in the main travelling direction (the right-and-left direction) in relation to the Y-bar 5, and transferring the Y-bar 5 in the sub travelling direction (the front-and-back direction) in relation to the table 6. At a time of transferring the Y-bar 5 in relation to the table 6 in the front-and-back direction in the printing operation on the print medium; at first, the slider transfer mechanism 17 transfers the slider 15 in the front-and-back direction in relation to the support member 8 and the slider 14. For example, at the time of transferring the Y-bar 5 toward a front side in relation to the table 6; at first, as shown in FIG. 7, the slider transfer mechanism 17 transfers the slider 15 to the front side, until the light-blocking part 47*a* blocks in the space between the light emitting element and the light receiving element of the sensor 45, and then stops the slider 15 there.

Subsequently, in a state where the contacting member 40, having been at the non-contacting position, is moved to the contacting position in order to stop the slider 15; as shown in FIG. 6, the slider transfer mechanism 16 transfers the slider 14 in relation to the support member 8 and the slider 15. At the time, the clutch 35 blocks up the power transmission route to the pinion 34 from the motor 32 so that the pinion 34 idly turns in relation to the output shaft of the motor 32 in order to maintain a state of the slider 15 being stopped. Moreover, at the time, the linear encoder 18 detects the movement distance of the slider 14 in relation to the support member 8.

Primary Effect of the Present Embodiment

As described above, according to the present embodiment, at the time of transferring the Y-bar 5 in relation to the table 6 in the front-and-back direction in the printing operation on the print medium; the slider 15, to which the sensor 39 is fixed, is transferred in relation to the support member 8 and the slider 14; and subsequently the slider 14, to which the linear scale 38 is fixed, is transferred in relation to the support member 8 and the slider 15, while the slider 15 is kept in a state of being stopped. In other words, according to the present embodiment; before transferring the slider 14, the sensor 39 is transferred together with the slider 15 in relation to the support member 8 and the slider 14; and subsequently, the slider 14 is transferred in relation to the support member 8 and the slider 15, in order to relatively move the linear scale 38 in relation to the sensor 39.

Therefore, according to the present embodiment, even though a distance, through which the slider 14 can move in relation to the support member 8, is comparatively long, and even though a length of the linear scale 38 is made short, it becomes possible to detect the movement distance of the slider 14 in relation to the support member 8 by use of the linear scale 38 and the sensor 39. In other words, according to the present embodiment, even though the distance, through which the Y-bar 5 can move in relation to the table 6 on which the print medium is placed, is comparatively long, the movement distance of the Y-bar 5 in relation to the table 6 can be detected, while the length of the linear scale 38 is made short. Therefore, according to the present embodiment, even though a length of the table 6 in the front-and-back direction is long, and even though the slider 14 is able to move in relation to the table 6 in an entire range of the front-and-back direction, it becomes possible to detect the movement distance of the Y-bar 5 in relation to the table 6, while the length of the linear scale 38 is made short.

According to the present embodiment, the pinion 34 is connected to the output shaft of the motor 32 by the intermediary of the clutch 35, in such a way that the clutch 35 transmits the power of the motor 32 to the pinion 34 when the slider 15 is transferred in relation to the support member 8 and the slider 14, and the clutch 35 blocks up the power transmission route to the pinion 34 from the motor 32 when the slider 14 is transferred in relation to the support member 8 and the slider 15. Therefore, according to the present embodiment, at the time when the slider 14 is transferred in relation to the support member 8 and the slider 15, it becomes possible by way of a comparatively easy way to maintain the slider 15, in the state of being stopped, at the stop position.

According to the present embodiment, the sliding mechanism 10 includes the retainer mechanism 19 that retains the slider 15, in the state of being stopped, at the stop position. Therefore, according to the present embodiment, it becomes possible to transfer the slider 14 in relation to the support member 8 and the slider 15, in the state where the slider 15 is stopped for sure. Therefore, according to the present embodiment, detection accuracy of the linear encoder 18 can be enhanced. Moreover, according to the present embodiment, since the sliding mechanism 10 includes the detection mechanism 20 for detecting the stop position of the slider 15 in relation to the slider 14, the slider 15 can automatically be stopped, on the basis of a detection result of the detection mechanism 20.

According to the present embodiment, the guide block 22 fixed to the slider 14 and the guide block 23 fixed to the slider 15 are engaged with the guide rail 21 in common, in such a way as to be slidable. Therefore, according to the present embodiment, being compared to a case where a guide rail with which the guide block 22 is engaged, and another guide rail with which the guide block 23 is engaged, are separately prepared; the structure of the sliding mechanism 10 in the present embodiment can be simplified.

Other Embodiments

Though the embodiment described above is an example of a preferred embodiment according to the present disclosure, the present disclosure is not restricted to the embodiment; and various modifications can be made within a scope having no alteration in the gist of the present disclosure.

In the embodiment described above, the linear scale 38 may be fixed to the slider 15, while the sensor 39 is fixed to the slider 14. Furthermore, in the embodiment described above, the motor 32 may be fixed to the slider 15, while the rack 33 is fixed to the slider 14. Nevertheless, the length of the linear scale 38 in the front-and-back direction is longer than the length of the sensor 39 in the front-and-back direction; and therefore, as mentioned in the embodiment described above, preferably the linear scale 38 should be fixed to the slider 14, with the sensor 39 being fixed to the slider 15, so that it becomes possible to downsize the slider 15. Moreover, as mentioned in the embodiment described above, preferably the motor 32 should be fixed to the slider 14, with the rack 33 being fixed to the slider 15, so that it becomes possible to downsize the slider 15.

In the embodiment described above, a guide rail with which the guide block 23 is engaged may be fixed to the slider 14. Moreover, in the embodiment described above, the slider transfer mechanism 17 may be provided, not with the rack 33 and the pinion 34, but alternatively with a ball screw; and may be provided with a belt fixed to the slider 15, and two pulleys over which the belt is placed.

In the embodiment described above, with the motor 32 being fixed to the slider 15, the rack 33 may be fixed to the support member 8. In other words, according to the embodiment described above, with the motor 32 being installed to the slider 15, the power transmission mechanism 36 may transmit power of the motor 32 to the support member 8 from the motor 32. In this case, the clutch 35 becomes unnecessary. Incidentally, while the rack 33 together with the slider 14 and the slider 15 can be transferred in relation to the support member 8 in the embodiment described above; in this case, the rack 33 cannot be transferred in relation to the support member 8; and therefore, the length of the rack 33 in the front-and-back direction becomes long. In other words, the power transmission mechanism 36 increases in size.

In the embodiment described above, the printer 1 may be a shaping device that shapes a three-dimensional article on the table 6. In this case, the printer 1 is provided, for example, with a lifting mechanism for lifting up and down the table 6. Furthermore, the sliding mechanism 10 to which the present disclosure is applied may be used for any device other than the printer 1.

What is claimed is:

1. A sliding mechanism comprising:

a slider that is capable of linearly moving in relation to a support member in a predetermined direction;

a second slider that is capable of linearly moving in relation to the support member as well as the slider in the same direction as a moving direction of the slider;

a slider transfer mechanism that transfers the slider;

a second slider transfer mechanism that transfers the second slider; and a linear encoder for detecting a movement distance of the slider in relation to the support member;

wherein the linear encoder includes:

a linear scale, fixed to one of the slider and the second slider, and a sensor, fixed to the other of the slider and the second slider;

wherein the second slider transfer mechanism transfers the second slider in relation to the support member and the slider; and subsequently, while the second slider is kept in a state of being stopped, the slider transfer mechanism transfers the slider in relation to the support member and the second slider.

2. The sliding mechanism according to claim 1, wherein the linear scale is fixed to the slider, and the sensor is fixed to the second slider.

3. The sliding mechanism according to claim 1, wherein the second slider transfer mechanism includes:

a motor, fixed to one of the slider and the second slider, and a power transmission mechanism for transmitting power of the motor to the other of the slider and the second slider, from the motor.

4. The sliding mechanism according to claim 3, wherein the power transmission mechanism includes:

a clutch, placed in a power transmission route, which leads from the motor to the other of the slider and the second slider; and when the second slider moves in relation to the support member and the slider, the clutch transmits the power of the motor to the other of the slider and the second slider; and when the slider moves in relation to the support member and the second slider, the clutch blocks up the power transmission route from the motor to the other of the slider and the second slider.

5. The sliding mechanism according to claim 4, wherein the power transmission mechanism includes:

a rack, fixed to the other of the slider and the second slider, and a pinion, connected to an output shaft of the motor by an intermediary of the clutch, and the pinion being meshed with the rack;

wherein the clutch transmits the power of the motor to the pinion, at a time when the second slider moves in relation to the support member and the slider; and the clutch blocks up the power transmission route from the motor to the pinion, at a time when the slider moves in relation to the support member and the second slider.

6. The sliding mechanism according to claim 5, wherein the motor is installed to the slider; and the rack is fixed to the second slider.

7. The sliding mechanism according to claim 2, wherein the second slider transfer mechanism includes:

a motor, fixed to one of the slider and the second slider, and a power transmission mechanism for transmitting power of the motor to the other of the slider and the second slider, from the motor.

8. The sliding mechanism according to claim 7, wherein the power transmission mechanism includes:

a clutch, placed in a power transmission route, which leads from the motor to the other of the slider and the second slider; and when the second slider moves in relation to the support member and the slider, the clutch transmits the power of the motor to the other of the slider and the second slider; and when the slider moves in relation to the support member and the second slider, the clutch blocks up the power transmission route from the motor to the other of the slider and the second slider.

9. The sliding mechanism according to claim 8, wherein the power transmission mechanism includes:

a rack, fixed to the other of the slider and the second slider, and a pinion, connected to an output shaft of the motor by an intermediary of the clutch, and the pinion being meshed with the rack;

wherein the clutch transmits the power of the motor to the pinion, at a time when the second slider moves in relation to the support member and the slider; and the clutch blocks up the power transmission route from the motor to the pinion, at a time when the slider moves in relation to the support member and the second slider.

10. The sliding mechanism according to claim 9, wherein the motor is installed to the slider; and the rack is fixed to the second slider.

11. The sliding mechanism according to claim 1, wherein the sliding mechanism includes a retainer mechanism for retaining the second slider, being in a stop state, at a stop position.

12. The sliding mechanism according to claim 11, wherein the retainer mechanism includes:

a contacting member that is capable of contacting the support member with a predetermined contact pressure; and a contacting member move mechanism that moves the contacting member between a contacting position, where the contacting member contacts the support member with the predetermined contact pressure, and a non-contacting position, where the contacting member is distant from the support member so as not to contact the support member;

wherein the contacting member move mechanism is installed to the second slider.

13. The sliding mechanism according to claim 1, wherein the sliding mechanism includes a detection mechanism for detecting a stop position of the second slider in relation to the slider.

14. The sliding mechanism according to claim 1, wherein the sliding mechanism includes:

a guide rail, which is fixed to the support member, for guiding the slider and the second slider in the moving direction of the slider;

a guide block, being fixed to the slider, which engages with the guide rail in such a way as to be slidable, and a second guide block, being fixed to the second slider, which engages with the guide rail in such a way as to be slidable.

15. An ink-jet printer comprising:

two sliding mechanisms, each of which being the sliding mechanism described in claim 1;

an ink-jet head that discharges an ink drop on a print medium;

a carriage on which the ink-jet head is mounted;

a carriage holding member that holds the carriage in such a way as to be movable in a main travelling direction; and the support member;

wherein the support member includes a table where the print medium is placed;

the two sliding mechanisms are individually placed at each of both ends of the table in the main travelling direction; and an end part of the carriage holding member in the main travelling direction is connected to the slider, and the slider and the second slider are movable in a sub travelling direction that is perpendicular to a vertical direction and the main travelling direction.

* * * * *